US007934819B2

(12) United States Patent
Tajima

(10) Patent No.: US 7,934,819 B2
(45) Date of Patent: May 3, 2011

(54) INKJET RECORDING HEAD CARTRIDGE

(75) Inventor: Hiroki Tajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 850 days.

(21) Appl. No.: 11/681,113

(22) Filed: Mar. 1, 2007

(65) Prior Publication Data

US 2007/0222837 A1 Sep. 27, 2007

(30) Foreign Application Priority Data

Mar. 23, 2006 (JP) ..... 2006-080906

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS 6,264,313 B1 * 7/2001 Mackowiak et al. ..... 347/85
6,585,359 B1 * 7/2003 Gasvoda et al. ..... 347/86
2006/0000171 A1 1/2006 Messenger et al.

FOREIGN PATENT DOCUMENTS

EP 1602486 A1 12/2005

* cited by examiner

*Primary Examiner* — Stephen D Meier
*Assistant Examiner* — Alexander C Witkowski
(74) *Attorney, Agent, or Firm* — Canon USA, Inc. IP Division

(57) ABSTRACT

An inkjet recording head cartridge includes a container body configured to accommodate a plural colors of ink. The container body has a first side surface and also has a projecting part. The inkjet recording head cartridge includes a recording head unit configured to have ink supply port arrays. The recording head unit also has discharge port arrays which discharge the plural colors of ink. The container body has a first partitioning wall and second partitioning walls. The first partitioning wall is configured to partition the inside of the container body to intersect with the ink supply port arrays, to form a first ink accommodating unit which has the first side surface, and to form a space which does not have the first side surface. The second partitioning walls are in contact with the first partitioning wall and divide the space into a plurality of ink accommodating units.

6 Claims, 6 Drawing Sheets

INKJET RECORDING HEAD CARTRIDGE

BACKGROUND OF THE INVENTION

1. Field of the Invention

The present invention relates to an inkjet recording head cartridge provided integrally with an inkjet recording head unit configured to perform recording by discharging liquid, such as ink, and with an ink accommodating unit configured to supply ink to the recording head unit. More particularly, the present invention relates to an inkjet recording head cartridge configured to discharge plural kinds of micro ink droplets.

2. Description of the Related Art

One of the aspects of inkjet recording systems is that they are considered non-impact recording systems. While an inkjet recording system has features that make high-speed recording possible; other attributes of inkjet recording systems are that they can perform recording on various recording media, and relatively no noises are generated while recording. Thus, an inkjet recording apparatus is widely employed as an apparatus serving as a recording mechanism of a printer, a copier, a facsimile, or a word processor.

An inkjet recording apparatus has been known, which employs an inkjet recording head cartridge provided integrally with an inkjet recording head unit configured to perform recording by discharging liquid, such as ink, and with an ink accommodating unit configured to supply ink to the recording head unit.

European Patent Publication No. EP1602486A1 discusses an inkjet recording head cartridge H100 that includes an ink accommodating unit whose inner space is partitioned into three chambers by a partition wall having a T-shape in plan view and that can accommodate different colors of ink, as shown in FIGS. 5A and 5B. A container body H501 of this cartridge has an L-shape in side view (see FIG. 5A) and also has a surface H201, on which a recording head unit H101 is disposed, on a projecting part H501*a* protruding from the bottom surface of the ink accommodating unit, which faces a cover H901. Openings through which ink is respectively supplied from associated chambers of the ink accommodating unit to the recording head unit H101, are provided in the surface H201. An ink flow path from each of the openings to a recording head is formed by providing a recording head unit H101. A discharge port array respectively corresponding to the chambers of the ink accommodating unit is formed in the recording head unit H101. Each color of ink is supplied from the associated chamber of the ink accommodating unit to the recording head through the associated ink flow path. A positioning unit H560 configured to perform positioning of the cartridge in the recording apparatus, and an electrical connection unit H302 configured to receive an electrical signal from a circuit of the recording apparatus are provided on a side surface H501*b* which is located at the side of the projecting part of the container body H501 in a direction intersecting with the discharge port array.

Also, U.S. Published Application No. 2006/0001711 discusses an inkjet recording head cartridge capable of accommodating at least four colors of ink.

Recently, it has been required that the inkjet recording system achieves high picture quality of the same level as a silver halide photograph. Thus, it has also been required that an amount of discharged liquid is reduced to a value which is equal to or less than, for example, 5 pl, and the resolution is raised to a high value (for example, about 1200×1200 dpi) to the extent that dots on a recording medium are hard to see (that is, grainy effects are unnoticeable).

In a case where such high-definition recording is performed, the distance between a discharge port surface, on which the discharge port array is provided, of the recording head in the recording apparatus, and a recording medium (that is, what is called a head-to-paper distance) is preferably as short as possible. In the recording apparatus that employs the inkjet recording head cartridge as discussed in the European Patent Publication No. EP1602486A1, conveyance members, such as a spur gear and a pinch roller, are provided to pinch the projecting part (H501*a* shown in FIG. 5A) of the cartridge. When intervals of supports for a recording medium are long, the recording medium is corrugated (or cockled) between the supports. Thus, it is necessary to secure a sufficient distance between the discharge port surface and the recording medium to prevent the discharge port surface from making contact with the recording medium. To reduce the distance between the discharge port surface and the recording medium, the distance (L1 shown in FIG. 5B) in the direction of the discharge port array of the projecting part, on which the recording head is disposed, is preferably short.

To reduce influence of an error caused when the cartridge is mounted in the recording apparatus, the distance (L2 shown in FIG. 5A) from a surface (H501*b* shown in FIG. 5A), on which the electrical connection unit is provided, in the vicinity of a reference surface, to the recording head unit H101 is preferably short.

Also, in addition to yellow ink, magenta ink, and cyan ink, high-quality print black ink differing in composition from black ink used to print characters can be employed as recording ink. Additionally, green ink and red ink may be used. To reduce a remaining amount of ink at the time of replacement of the cartridge, accommodated amounts of each color ink are preferably as equal as possible when a cartridge can accommodate more than three colors of ink including such additional ink.

However, it is difficult for the inkjet recording head cartridge discussed in the U.S. Published Application No. 2006/0001711 to simultaneously solve all of the above issues. A problem arises when high quality recording is performed by using this inkjet recording head cartridge. For example, as shown in FIG. 6, the distance L1 (see also FIG. 5*b*) in an inkjet recording head cartridge H200 whose inner space is divided by partitioning walls H701, H702, and H703 into four chambers, becomes long. When the distance L1 is reduced in this inkjet recording head cartridge, the capacity of ink accommodating units H601, and H602 at the side of the electric connection unit becomes small, as compared with the remaining ink accommodating units H603, and H604.

SUMMARY OF THE INVENTION

The present invention is directed to an inkjet recording head cartridge enabled to accommodate four or more color inks with substantially no variation in color-ink-accommodating-amounts of ink accommodating units, and to easily achieve high-definition recording.

According to an aspect of the present invention, an inkjet recording head cartridge includes a container body configured to accommodate a plural colors of inks and to have a first side surface having an electrical connection unit, and a projecting part that is provided on a part of a bottom surface thereof and that is biased toward the first side surface, and also includes a recording head unit configured to have a plurality of ink supply port arrays configured to be parallel to one another and to supply the plural colors of inks, and to also have a plurality of discharge port arrays configured to be provided along the plurality of ink supply port arrays and to discharge the plural colors of inks. A direction of the ink supply port array intersects with the first side surface. The container body has a first partitioning wall and a plurality of second partitioning walls. The first partitioning wall is configured to partition inside of the container body to intersect with the plurality of ink supply port arrays when viewed from a direction perpendicular to a surface of the recording head unit in which the discharge port arrays are provided, to form a first ink accommodating unit which has the first side surface, and to form a space which does not have the first side surface. The plurality of second partitioning walls are configured to be in contact with the first partitioning wall and to divide the space, which does not have the first side wall, into a plurality of ink accommodating units.

With this configuration, even in a case where the ink accommodating amounts of the ink accommodating units are not extremely different from each other, it is easily achieved to collectively form ink supply openings in the vicinity of the first partitioning wall. Consequently, the ink flow path extending from each of the ink accommodating units to the ink supply port of the recording head can be formed to be short and to have a simple shape. Accordingly, the projecting part can be made compact. Thus, the length of the projecting part of the recording head in the direction of the discharge port array can be shortened. Also, the distance from a surface, on which the electrical connection portion is provided, to the recording head unit can be shortened.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EXEMPLARY EMBODIMENTS

Various exemplary embodiments, features, and aspects of the invention will be described in detail below with reference to the drawings.

Hereinafter, a configuration of an inkjet recording head cartridge according to an exemplary embodiment of the present invention is described with reference to FIGS. 1A, 1B, and 2.

An inkjet recording head cartridge H1001 according to the present exemplary embodiment employs an electrothermal conversion element configured to generate thermal energy so as to cause film boiling of ink in response to an electric signal.

The inkjet recording head cartridge H1001 is used to discharge ink of four colors, such as black, cyan, magenta, and yellow. As shown in FIGS. 1A and 1B, the inkjet recording head cartridge H1001 has the following elements: a recording element substrate H1101, an electric wiring tape H1301, a flow path member H1410, an ink accommodating member H1501, filters H1701 to H1704, ink absorbers H1601 to H1604, a cover member H1901, and a seal member H1801.

Figure 2:
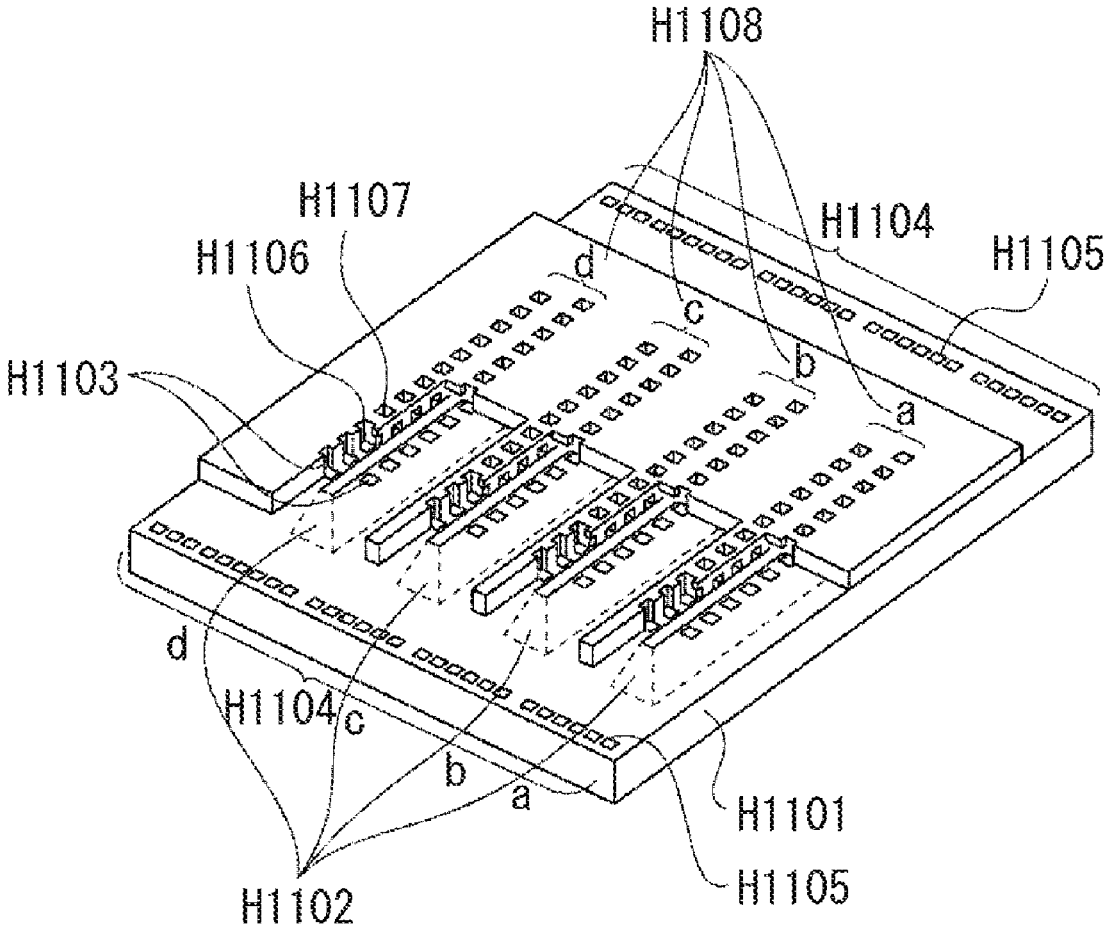
FIG. 2 is an exploded perspective view illustrating an example of a recording head unit of the inkjet recording head cartridge.

FIG. 2 is a partially broken perspective view illustrating a configuration of the recording element substrate H1101 serving as an inkjet recording head unit. Four ink lines H1108 of ink supply ports H1102, which respectively correspond to black ink, cyan ink, magenta ink, and yellow ink, are formed in parallel to one another. Electrothermal conversion elements H1103 and discharge ports H1107 arranged in lines are disposed in a zigzag arrangement along both sides of each ink supply port array H1102. The recording element substrate H1101 includes Si-substrate, electric wires, a fuse, and an electrode section H1104. Ink flow path walls H1106 and the discharge port arrays H1107 are formed on the recording element substrate H1101 with a resin material by photolithographic technology. Also, bumps H1105 made of Au are formed on an electrode unit H1104 configured to supply electric power to the electric wires. According to the present exemplary embodiment, the electrothermal conversion elements H1103 and the discharge ports H1107 are disposed so that each of the electrothermal conversion elements H1103 is opposed to the discharge port H1107.

On a rear surface of the substrate (a surface opposite to the surface in which the discharge ports are formed), an opening width of each ink supply port is about 1 mm. The interval between the ink supply ports is about 1.5 mm. The discharge port array has a length of about 15 mm.

Figure 1A:
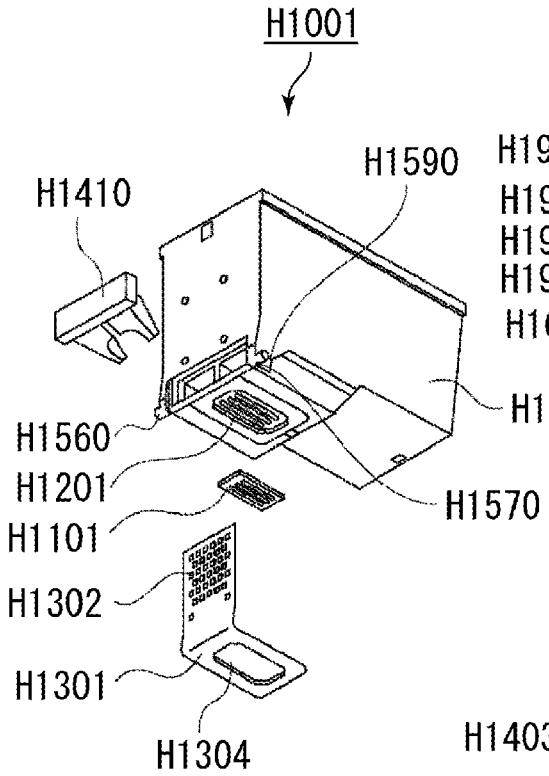
FIGS. 1A and 1B are exploded perspective view illustrating an inkjet recording head cartridge according to an exemplary embodiment of the present invention.

Referring to FIG. 1A, the electric wiring tape H1301 constitutes an electric signal path used to apply electric signals, according to which ink is discharged, to the recording element substrate H1101. An opening used to incorporate the recording element substrate is formed in the electric wiring tape H1301. An electrode terminal H1304 which is connected to the electrode section H1104 is formed in the vicinity of an edge of this opening. An external signal input terminal H1302 used to receive electric signals from a main unit is formed on the electric wiring tape H1301. The electrode terminal H1304 and the external signal input terminal H1302 are connected to each other by a continuous copper foil wiring pattern.

The ink accommodating member H1501 is formed by resin molding. Preferably, a resin material, into which glass filler is mixed by 5% to 40%, is used to enhance form stiffness.

Figure 1B:
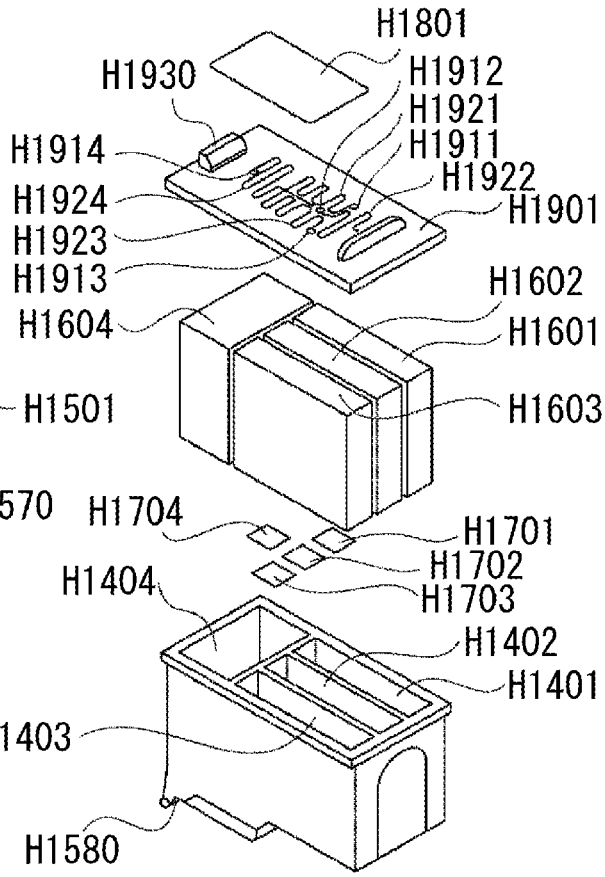

As shown in FIGS. 1A and 1B, the ink accommodating member H1501 has spaces in which the ink absorbers H1601, H1602, H1603, and H1604 used to generate a negative pressure so as to hold black ink, cyan ink, magenta ink, and yellow ink, are held independent of one another, respectively.

In each of the spaces, an ink flow path, through which each color ink is introduced into the associated ink supply port H1102 of the recording element substrate H1101, is provided independent of one another. The ink accommodating member H1501 serves as both an ink tank and an ink supply flow path.

The flow path member H1410 is connected to the ink accommodating member H1501 to form ink flow paths independent of one another. The flow path member H1410 is fit into the ink accommodating member H1501 in the same direction as the array of the discharge ports H1107 of the recording element substrate H1101. Thus, a surface of the ink accommodating member H1501, to which the recording element substrate H1101 is attached, and head reference surfaces H1560, H1570, H1580, and H1590 can be provided in the same member. Consequently, a high-definition recording head can be constructed.

Filters H1701, H1702, H1703, H1704 configured to prevent dust from entering the recording element substrate H1101 are connected by welding to a boundary between the ink accommodating member H1501 and the ink absorbers H1601, H1602, H1603, and H1604 provided at an upstream side of each ink flow path.

Ink supply slots H1201 configured to supply black ink, cyan ink, magenta ink, and yellow ink to the recording element substrate H1101 are formed at a downstream part of the ink flow path. The recording element substrate H1101 is fixed to the ink accommodating member H1501 with good positional precision by bonding, so that the ink supply ports H1102 (see FIG. 2) of the recording element substrate H1101 communicate with the ink supply slots H1201 of the ink accommodating member H1501. Preferably, a first adhesive agent used for the bonding has a low viscosity, and a low curing temperature, and is quickly cured and has a relatively high hardness and has a resistance to ink after cured. For example, a thermosetting adhesive agent including an epoxy resin as a main ingredient is used. Preferably, at that time, an adhesive layer has a thickness of about 50 μm.

A rear surface of a part of the electric wiring tape H1301 is fixed to a flat surface around each ink supply port H1102 by bonding using a second adhesive agent. An electrical connection part between the recording element substrate H1101 and the electric wiring tape H1301 is sealed with a sealant. The electric connection part is protected from being corroded by ink and from an external impact. An unbonded part of the electric wiring tape H1301 is folded back and is fixed by thermal caulking or bonding to a side surface generally perpendicular to the surface of the ink accommodating member H1501, on which the ink supply slots H1201 are formed.

The cover member H1901 is welded to an upper opening of the ink accommodating member H1501 to thereby close the independent spaces in the ink accommodating member H1501. Incidentally, the cover member H1901 has narrow openings H1911, H1912, H1913, and H1914 used to relieve a varying pressure of each chamber of the ink accommodating member H1501, and also has fine slots H1921, H1922, H1923, and H1924, each of which communicates with the associated narrow openings at one end thereof. The fine slots H1921, H1922, H1923, and H1924 join together halfway to the other ends thereof. Also, most of the narrow openings H1911, H1912, H1913, and H1914 and the fine slots H1921, H1922, H1923, and H1924 are covered with the seal member H1801. The other end of the fine slot H1922 is opened. Thus, an atmospheric air communicating port is formed. The cover member H1901 has an engaging part H1930 adapted to fix the inkjet recording head cartridge H1001 to the inkjet recording apparatus.

First Exemplary Embodiment

Figure 3A:
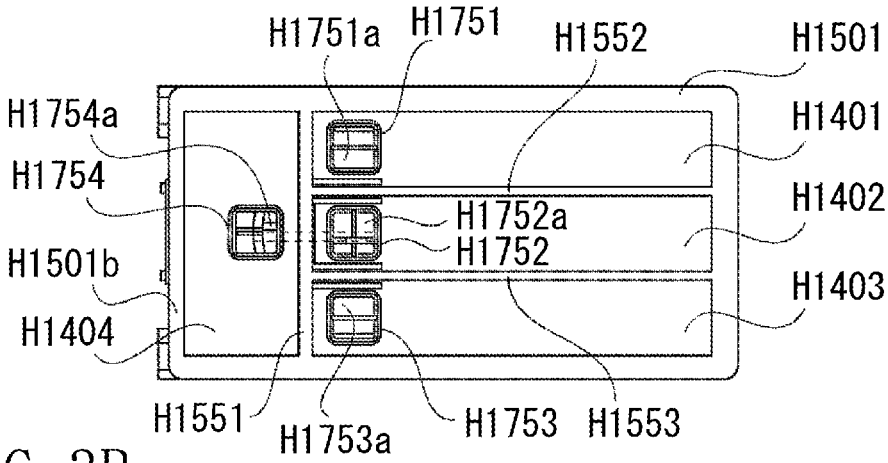
FIGS. 3A to 3D are a top view, side views, and a cross-sectional view illustrating the inkjet recording head cartridge according to a first exemplary embodiment of the invention.
Figure 3B:
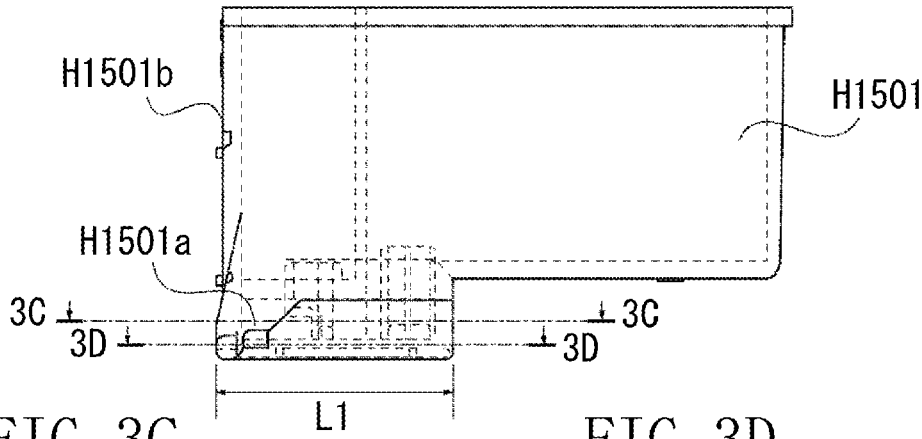
Figure 3C:
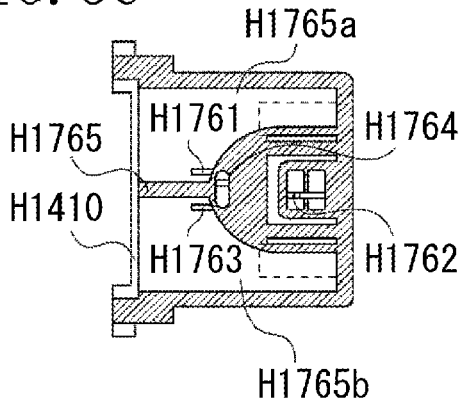
Figure 3D:
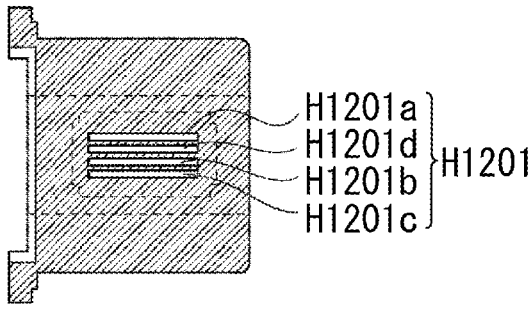

FIGS. 3A to 3D illustrate a container body of the inkjet recording head cartridge according to a first exemplary embodiment of the present invention. FIG. 3A is a top view of the container body. FIG. 3B is a side view of the container body. FIG. 3C is a cross-sectional view taken along line 3C-3C shown in FIG. 3B from top. FIG. 3D is a cross-sectional view taken along line 3D-3D shown in FIG. 3B from top.

As shown in FIGS. 3A and 3B, the ink accommodating member H1501 serving as the container body has a first side surface H1501*b*, which has an electric connection part connected to the recording element substrate H1101, and also has a projecting part H1501*a* which is provided in a bottom surface thereof and is biased toward the first side surface H1501*b*. The ink accommodating member H1501 is shaped generally like a letter "L".

The ink accommodating member H1501 has a first partitioning wall H1551, which partitions an inner space surrounded by outer walls into four chambers, and also has second partitioning walls H1552 and H1553. The thickness of the first and second partitioning walls and the outer wall of the container body depends on the ink accommodating amount of the container. In a case where the present exemplary embodiment accommodates ink of about 40 cc (an amount of each color ink is about 10 cc), from the viewpoint of the strength of the walls, the thickness of the partitioning walls is set at a value ranging from 1 mm to 1.5 mm. The thickness of the outer wall is set at a value ranging from 2 mm to 3 mm.

The first partitioning wall H1551 according to the present exemplary embodiment is provided to partition a longer side of a generally rectangular shape of the outer wall of the container, as shown in FIG. 3A. As shown in a top view illustrated in FIG. 3A, the first partitioning wall H1551 is parallel to the side surface H1501*b* having the electric connection part. As shown in FIGS. 3B and 3D, the first partitioning wall H1551 shown in FIG. 3A is formed so that an extension drawn from the first partitioning wall H1551 passes across the ink supply slots H1202 (i.e., H1201*a* to H1201*d*) provided in the projecting part H1501*a* to supply ink to the recording element substrate H1101. The recording element substrate H1101 is provided on a surface in which the ink supply slots H1201 of the projecting part H1501*a* are provided. Thus, in a case where the recording element substrate H1101 is mounted thereon, the first partitioning wall H1551 intersects with the ink supply port array of the recording element substrate H1101 as viewed from the direction in which FIG. 3A is drawn. The first partitioning wall H1551 partitions the inside of the ink accommodating member H1501 into a first ink accommodating unit H1404, which has the first side surface H1501*b*, and the other space (H1401 to H1403).

The second partitioning walls H1552 and H1553 are in contact with the first partitioning wall H1551 and partition the other space into three ink accommodating units H1401, H1402, and H1403, which are generally equal to one another in capacity. In the present exemplary embodiment, the second partitioning walls H1552 and H1553 are provided generally in parallel to the longer side of the generally rectangular shape formed by the outer walls of the container shown in FIG. 3A.

Thus, the four ink accommodating units H1401 to H1404, which are generally equal to one another in capacity, are formed in the ink accommodating member H1501 by the first partitioning wall H1551 and a plurality of second partitioning walls H1552 and H1553. The four ink accommodating units H1401 to H1404 respectively have filter towers H1751 to H1754. The filters H1701 to H1704 (see FIG. 1B) are mounted in the filter towers H1751 to H1754, respectively. Thus, ink contained in each of the ink accommodating units H1401 to H1404 can be supplied to the ink supply slots H1201. The first partitioning wall H1551 and the second partitioning walls H1552 and H1553 are disposed in such a way, that the filter towers H1751 to H1754 of the ink accommodating units H1401 to H1404 can be collectively provided in the vicinity of the first partitioning wall H1551. Consequently, the ink supply path from each base end of the filter towers to the associated ink supply slot H1202 can be shortened. Accordingly, the size of the projecting part including the ink supply paths can be brought close to that of the recording element substrate H1101. Also, the length L1 of the projecting part H1501 shown in FIG. 3B can be shortened. Especially, according to the present exemplary embodiment, the first partitioning wall H1551 is formed to intersect with the center of the discharge port array of the recording element substrate H1101 as viewed in FIG. 3A. Accordingly, the ink supply paths can be disposed within the projecting part H1501*a* without increasing the length L1 of the projecting part H1501*a*.

Next, the ink supply path from the filter tower to the ink supply slot is described below. The ink accommodating units H1401 to H1404 according to the present exemplary embodiment have openings H1751*a* to H1754*a* serving as ends of the ink supply paths, at ends (or bases) of the filter towers H1751 to H1754, on a side where no filter is provided.

A first ink accommodating unit H1404 has the opening H1754*a* at the base of the filter tower H1754 and is connected to the ink flow path. This ink flow path is connected to the ink supply slot H1201*d* shown in FIG. 3D. The end opening H1764 of the ink supply slot H1201*d* has a shape shown in FIG. 3C.

Among the three ink accommodating units H1401 to H1403 formed by the second partitioning walls H1552 and H1553, the ink accommodating unit H1402 has two second partitioning walls. The ink accommodating unit H1402 has an opening H1752*a* provided at the base of the filter tower H1752 and is connected to the ink flow path. This ink flow path is connected to the ink supply slot H1201*b* shown in FIG. 3D. The opening end H1762 of the ink supply slot H1201*b* has a shape shown in FIG. 3C.

The ink-supply-slot-side opening H1764 of the ink accommodating unit H1404 and the ink-supply-slot-side opening H1762 of the ink accommodating unit H1402 are formed to be intervened by the first partitioning wall H1551, as viewed from the direction in which FIG. 3A is drawn. With this positional relationship, a sufficient distance between the openings H1762 and H1764 shown in FIG. 3C can be ensured. The ink supply path can easily be formed in the projecting part H1501*a*.

Also, the two ink supply paths are formed so that the filter-base-side opening and the ink-supply-slot-side opening coincide with each other (at least overlap with each other), as viewed from the direction in which FIG. 3A is drawn. Thus, all of the ink supply paths are formed to extend in a direction perpendicular to paper, on which FIG. 3C is drawn (i.e., a direction perpendicular to a discharge surface of the recording element substrate H1101). This direction coincides with the direction, in which the filter tower H1752 extends, and with the direction in which the outer wall of the container and the partitioning walls extend. Thus, at the time of manufacturing the container body by injection molding, demolding can easily be performed. Consequently, the present exemplary embodiment has an advantage in excellent productivity.

Meanwhile, the ink supply paths of the ink accommodating units H1401 and H1403, each of which has only one second partitioning wall, differ in configuration from the ink supply paths of the ink accommodating units H1402 and H1404. The filter towers H1751 and H1753 of the ink accommodating units H1401 and H1403 have the openings H1751*a* and H1753*a* at the bases, respectively. The openings H1751*a* and H1753*a* respectively communicate with spaces H1765*a* and H1765*b* defined in the projecting part H1501*a* shown in FIG. 3C by the third partitioning wall H1765 and the flow path member H1410. Also, openings H1761 and H1763 respectively communicating with the ink supply slots H1201*a* and H1201*c* shown in FIG. 3D are provided in the spaces H1765*a* and H1765*b*, respectively.

With this configuration, the flow paths can easily be formed in the ink accommodating units H1401 and H1403 by the ink accommodating member H1501 and the flow path member H1410. The filter-base-side opening and the ink-supply-slot-side opening of these flow paths do not overlap with each other when viewed from the direction in which FIG. 3C is drawn. However, because the spaces H1765*a* and H1765*b* are large enough for that, ink supply performance is not sacrificed.

Second Exemplary Embodiment

Figure 4A:
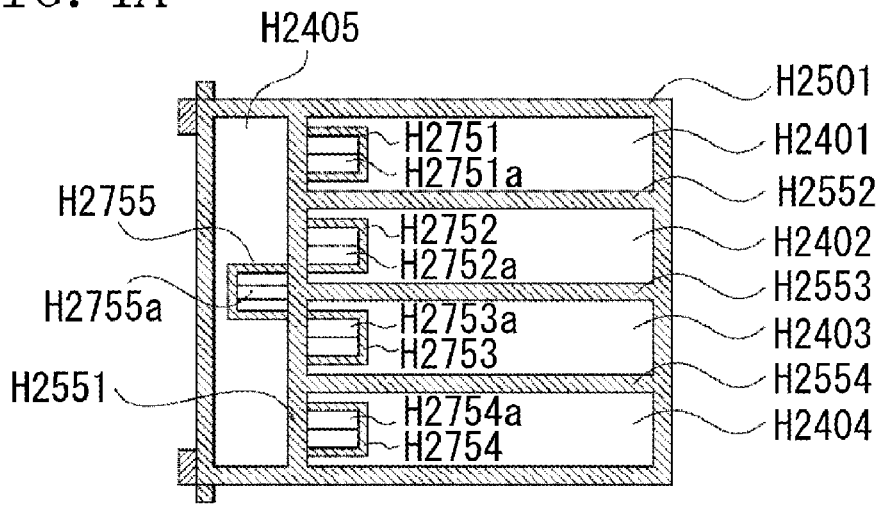
FIGS. 4A to 4D are a top view, side views, and a cross-sectional view illustrating an inkjet recording head cartridge according to a second exemplary embodiment of the invention.
Figure 4B:
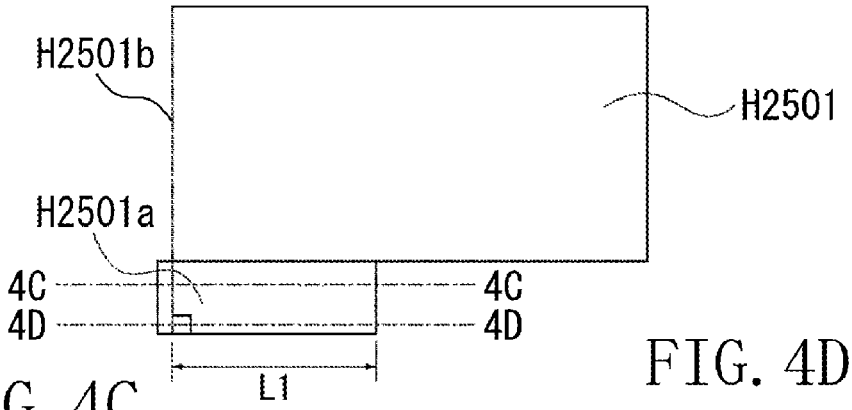
Figure 4C:
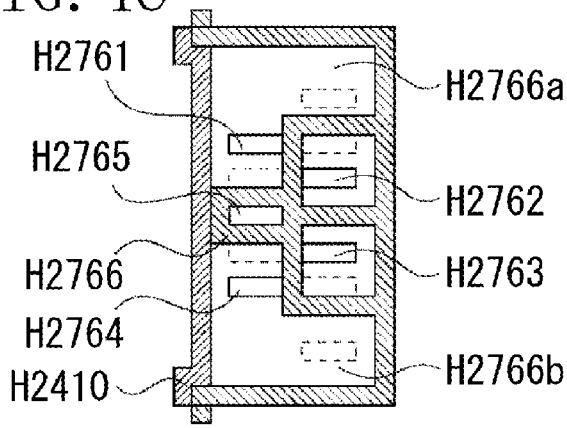
Figure 4D:
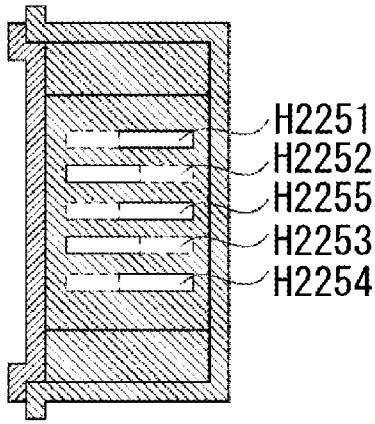
Figure 5A:
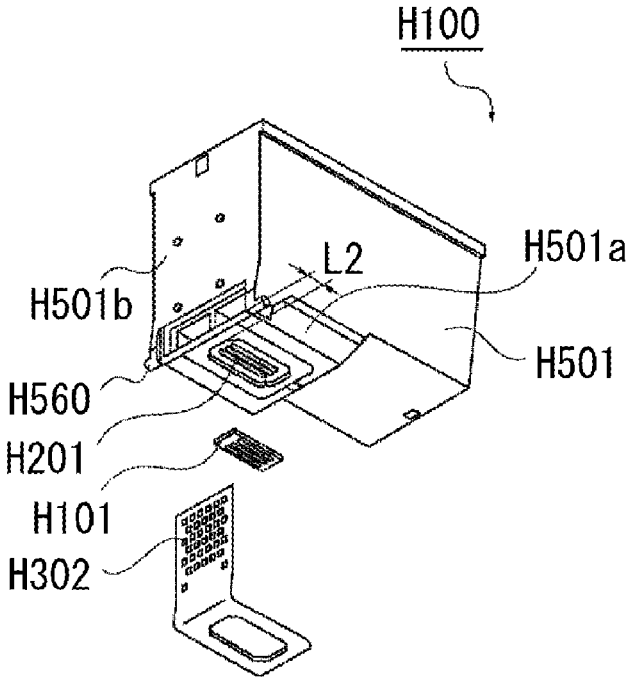
FIG. 5A (PRIOR ART)
FIGS. 5A and 5B are exploded perspective views illustrating an example of a conventional inkjet recording head cartridge.
Figure 5B:
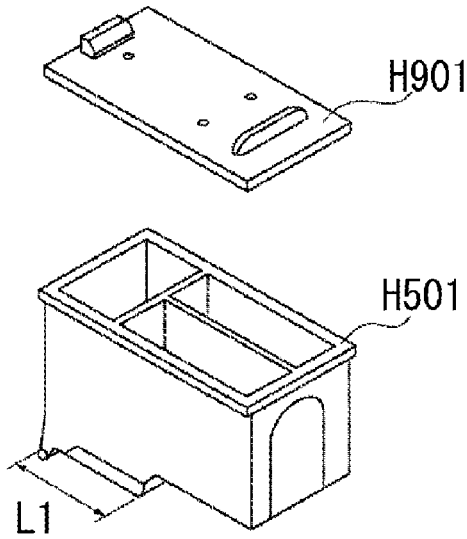
FIG. 5B (PRIOR ART)
Figure 6:
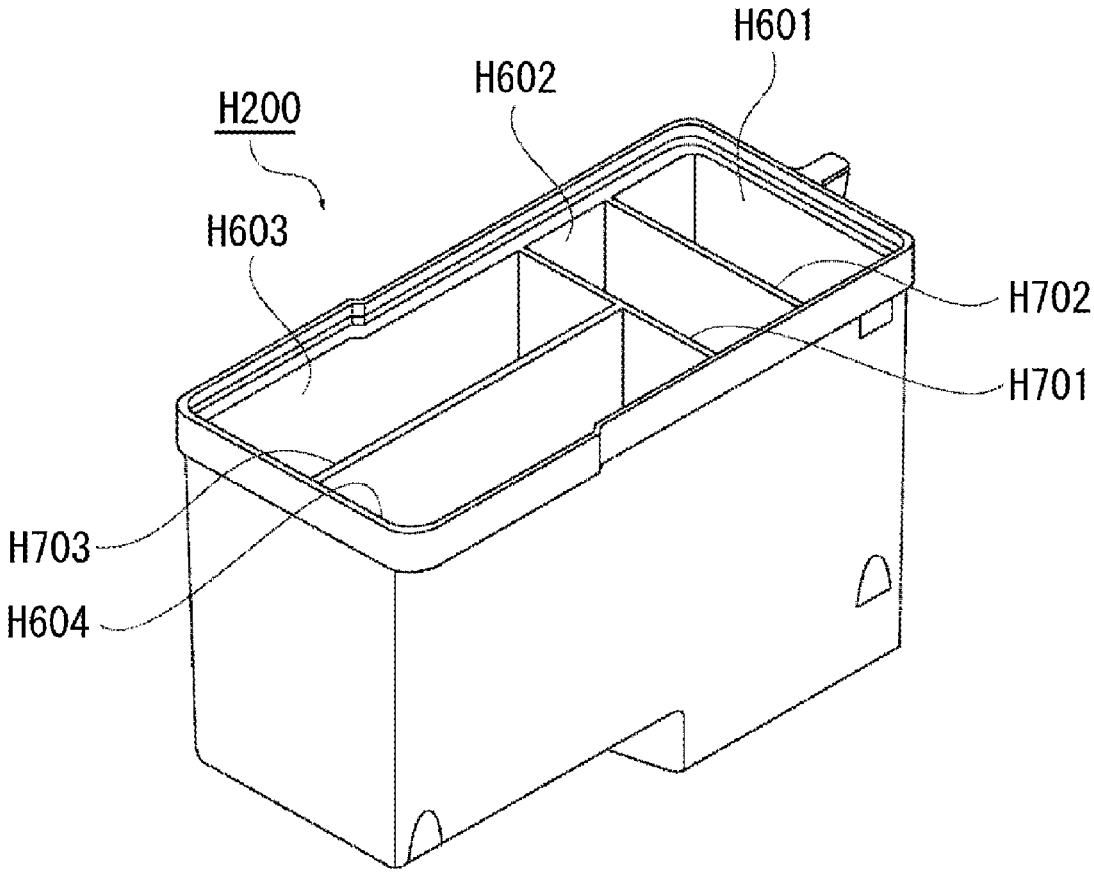
FIG. 6 (PRIOR ART)
FIG. 6 is a perspective view illustrating an example of an ink accommodating unit of the conventional inkjet recording head cartridge.

FIGS. 4A to 4D illustrate a container body of the inkjet recording head cartridge according to a second exemplary embodiment of the present invention. FIG. 4A is a top view of the container body. FIG. 4B is a side view of the container body. FIG. 4C is a cross-sectional view taken along line 4C-4C shown in FIG. 4B from top. FIG. 4D is a cross-sectional view taken along line 4D-4D shown in FIG. 4B from top.

The second exemplary embodiment differs from the first exemplary embodiment in that the number of the second partitioning walls is increased by 1, and that the second exemplary embodiment can accommodate five color inks.

As shown in FIGS. 4A and 4B, the ink accommodating member H2501 serving as the container body has a first side surface H2501*b*, which has an electric connection part connected to the recording element substrate, and also has a projecting part H2501*a* provided in a bottom surface thereof which is biased toward the first side surface H2501*b*. The ink accommodating member H2501 is shaped generally like a letter "L".

The ink accommodating member H2501 has a first partitioning wall H2551, and also second partitioning walls H2552, H2553, and H2554 which partition an inner space surrounded by outer walls into five chambers.

The first partitioning wall H2551 of the present exemplary embodiment is formed so that an extension drawn from the first partitioning wall H2551 passes across the ink supply slots H2251 to H2255 provided in the projecting part H2501*a*, when viewed from the direction from which FIG. 4A is drawn, similarly to the first exemplary embodiment. The inside of the ink accommodating member H2501 is partitioned by the first partitioning wall H2551 into the first ink accommodating unit H2405, which has the first side surface H2501*b*, and the remaining spaces (H2401 to H2404).

The second partitioning walls H2552, H2553, and H2554 are in contact with the first partitioning wall H2551 and partition the other space into four ink accommodating units H2401, H2402, H2403 and H2404, which are generally equal to one another in capacity. In the present exemplary embodiment, the second partitioning walls H2552, H2553 and H2554 are provided generally in parallel to the longer side of the generally rectangular shape of the outer walls of the container shown in FIG. 4A.

Thus, the five ink accommodating units H2401 to H2404, which are generally equal to one another in capacity, are formed in the ink accommodating member H2501 by the first partitioning wall H2551 and the second partitioning walls H2552, H2553 and H2554. The five ink accommodating units H2401 to H2405 respectively have filter towers H2751 to H2755. Thus, ink contained in each of the ink accommodating units H2401 to H2405 can be supplied to the ink supply slots H2251 to H2255.

According to the present exemplary embodiment, the first partitioning wall and the second partitioning walls are disposed in this way, so that the filter towers of the ink accommodating units can be collectively provided in the vicinity of the first partitioning wall. Consequently, the ink supply path from each of the base ends of the filter towers to associated ink supply slots H1202 can be shortened. Accordingly, the size of the projecting part including the ink supply paths can be set to be close to the recording element substrate H2101. Also, the length L1 of the projecting part H1501 shown in FIG. 4B can be shortened.

Next, the ink supply path from the filter tower to the ink supply slot is described. Each of the ink accommodating units H2401 to H2405 according to the present exemplary embodiment has associated openings H2751*a* to H2755*a* serving as ends of the ink supply paths, at its end (or base). The openings H2751*a* to H2755*a* are provided at a side of associated filter towers H2751 to H2755, at which no filter is provided.

The first ink accommodating unit H2405 has the opening H2755*a* at the base of the filter tower H2755 and is connected to the ink flow path. This ink flow path is connected to the ink supply slot H2255 shown in FIG. 4D. The end opening H2765 of the ink supply slot has a shape shown in FIG. 4C.

Among the four ink accommodating units H2401 to H2404 formed by the second partitioning walls H2552, H2553 and H2554, the ink accommodating units H2402 and H2403 have two second partitioning walls. The ink accommodating units H2402 and H2403 have openings H2752*a* and H2753*a* provided at the bases of the filter towers H2752 and H2753 and are connected to the ink flow paths. The ink flow paths are connected to the ink supply slots H2252 and H2253 shown in FIG. 4D. The opening ends H2762 and H2763 of the ink supply slots H2252 and H2253 have shapes shown in FIG. 4C.

The ink-supply-slot-side opening H2765 of the ink accommodating unit H2405 and the ink-supply-slot-side openings H2762 and H2763 of the ink accommodating units H2402 and H2403 are formed to be intervened by the first partitioning wall H2551, as viewed from the direction in which FIG. 4A is drawn. With this positional relationship, a sufficient distance between the openings H2762, H2763 and H2765 shown in FIG. 4C can be ensured. The ink supply path can easily be formed in the projecting part H2501*a*. Additionally, the present exemplary embodiment is adapted so that the opening H2765 is formed between the openings H2762 and H2763 when viewed in a direction perpendicular to paper on which FIG. 4C is drawn. With this positional relationship, a sufficient distance between the openings H2762 and H2763 can be ensured.

Also, the three ink supply paths are formed so that the filter-base-side opening and the ink-supply-slot-side opening coincide with each other (at least overlap with each other), as viewed from the direction in which FIG. 4A is drawn. Thus, similarly to the first exemplary embodiment, the present exemplary embodiment has an advantage in excellent productivity.

Meanwhile, the ink supply paths of the ink accommodating units H2401 and H2403, each of which has only one second partitioning wall, have configurations similar to those of the associated ink supply paths of the first exemplary embodiment. That is, the filter towers H2751 and H2753 of the ink accommodating units H2401 and H2403 have the openings H2751*a* and H2754*a* at the bases, respectively. The openings H2751*a* and H2754*a* respectively communicate with spaces H2766*a* and H2766*b* defined in the projecting part H2501*a* shown in FIG. 4C by the third partitioning wall H2766 and the flow path member H2410. Also, openings H2761 and H2764 respectively communicating with the ink supply slots H2251 and H2254 shown in FIG. 4D are provided in the spaces H2766*a* and H2766*b*, respectively.

With this configuration, the flow paths can easily be formed in the ink accommodating units H2401 and H2404 by the ink accommodating member H2501 and the flow path member H2410.

Incidentally, in the foregoing description of the exemplary embodiments, the terms "side surface" and "bottom surface" have been used, for convenience of describing relatively the position relationship of the outer wall surface of the container body. These terms do not limit the position in the container body at the time of use and distribution.

According to the above exemplary embodiments, in the inkjet recording head cartridge integrally accommodating four or more color inks, accommodating amounts of the color inks can be equal to one another, and high-definition recording can be achieved when mounted in a recording apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-080906 filed Mar. 23, 2006, which is hereby incorporated by reference herein in its entirety.

What is claimed:

1. An inkjet recording head cartridge, comprising:

a container body configured to accommodate plural colors of inks and having a projecting part that is provided on a part of a bottom surface thereof and that is biased toward a side surface; and a recording head unit having a plurality of ink supply ports configured parallel to one another for supplying the plural colors of inks, a plurality of discharge port arrays provided along the plurality of ink supply ports for discharging the plural colors of inks, and electrothermal conversion elements provided in correspondence with discharge ports forming the plurality of discharge port arrays for generating energy to discharge ink, the recording head unit being mounted at the projecting part of the container body in an arranging direction of the plurality of ink supply ports being along the side surface, wherein the container body comprises, a first partitioning wall configured to partition an inside of the container body to intersect with the plurality of ink supply ports when viewed from a direction perpendicular to a surface of the recording head unit in which the plurality of discharge port arrays are provided, to form a first ink accommodating unit which has the side surface, and to form a space which does not have the side surface;

a plurality of second partitioning walls configured to be in contact with the first partitioning wall and to divide the space, which does not have the side surface, into a plurality of second ink accommodating units; and a plurality of ink flow paths, the plurality of ink flow paths communicating with the first ink accommodating unit and the second ink accommodating units, and the plurality of ink supply ports corresponding to the first ink accommodating unit and the second ink accommodating units, wherein a plurality of ink-accommodating-unit-side openings of the plurality of ink flow paths are provided in the vicinity of the first partitioning wall.

2. The inkjet recording head cartridge according to claim 1, wherein the first partitioning wall is formed to intersect with a center of each discharge port array when viewed from the direction perpendicular to the surface of the recording head unit, in which the discharge port arrays are provided.

3. The inkjet recording head cartridge according to claim 1, wherein the plurality of ink flow paths include a first ink flow path communicating with the first ink accommodating unit, and at least one second ink flow path communicating with the second ink accommodating unit having the plurality of second partitioning walls, among the plurality of second ink accommodating units, and wherein an ink-supply-port-side opening of the first ink flow path and at least one ink-supply-port-side opening of the at least one the second ink flow paths are provided to face across the first partitioning wall when viewed from the direction perpendicular to a surface of the recording head unit, in which the discharge port arrays are provided.

4. The inkjet recording head cartridge according to claim 3, wherein the ink-accommodating-unit-side opening and the ink-supply-port-side end opening of the first ink flow paths and at least one the second ink flow paths, have an overlapping part when viewed from the direction perpendicular to the surface of the recording head unit, in which the discharge port arrays are provided.

5. The inkjet recording head cartridge according to claim 3, wherein a plurality of ink discharge port grooves respectively corresponding to the plurality of ink supply ports are formed in a recording head mounting unit of the projecting part, and wherein the plurality of ink discharge port grooves communicate with the ink-supply-port-side openings of the ink flow paths.

6. The inkjet recording head cartridge according to claim 1, wherein the projecting part has an opening formed in the side surface, and a third partitioning wall configured to partition a space in the opening, and wherein an ink flow path communicating with the second ink accommodating unit, which has only one second partitioning wall, among the plurality of the second ink accommodating units is formed by a flow path member, which blocks up the opening, and the third partitioning wall.

* * * * *